United States Patent [19]

Rohde

[11] 4,267,404

[45] May 12, 1981

[54] SUPPORTING DEVICE FOR TOROIDAL COIL HAVING INTEGRAL TERMINAL HOUSINGS

[75] Inventor: Carl W. Rohde, Hellam, Pa.

[73] Assignee: AMP Incorporated, Harrisburg, Pa.

[21] Appl. No.: 32,999

[22] Filed: Apr. 25, 1979

[51] Int. Cl.[3] ..... H01F 17/08; H01F 15/10; H01F 15/02

[52] U.S. Cl. ..... 178/46; 336/65; 336/196

[58] Field of Search ..... 336/65–68, 336/90, 92, 96, 192, 208; 178/45–46; 211/49 R; 333/185; 339/119 R, 121, 122 R, 125 R

[56] References Cited

U.S. PATENT DOCUMENTS

| | | | |
|---|---|---|---|
| B 523,952 | 11/1974 | Moser et al. | 336/65 |
| 3,865,980 | 2/1975 | Moser et al. | 178/46 |
| 3,952,906 | 4/1976 | Georgopulos | 178/46 X |

*Primary Examiner*—Marvin L. Nussbaum
*Attorney, Agent, or Firm*—Frederick W. Raring

[57] ABSTRACT

A terminal housing having integral coil supporting means for a toroidal coil comprises a coil support portion having a coil locating post extending therefrom which is received in the center opening of the coil. The housing is integral with a deformable housing support arm which is spaced from and extends parallel to the locating post. The housing has terminal-receiving cavities therein which receive the terminals that connect the coil wires to the insulated wires extending from a cable. After these connections are made, the housing is moved against one side of the coil and is latched to the upper end of the locating post by integral latching means so that it extends across the coil. The housing and the lower end of the locating post have additional latching means so that a coil having a support and housing thereon can be stacked against identical coils and housings, and latched to the adjacent coils. Also disclosed is an improved loading coil assembly in which the loading coils are stacked against each other and held in position by coil supports and housings.

12 Claims, 7 Drawing Figures

SUPPORTING DEVICE FOR TOROIDAL COIL HAVING INTEGRAL TERMINAL HOUSINGS

FIELD OF THE INVENTION

This invention relates to terminal housing intended for use with toroidal coils and to loading coil assemblies having improved means for supporting the coils in the assembly and establishing electrical connections between the windings of the coils and the insulated conductors in the stub cable of the assembly.

BACKGROUND OF THE INVENTION

A loading coil assembly comprises a cable, generally referred to as a stub cable, containing a plurality of pairs of insulated wires and a plurality, equal to one half of the number of wire pairs in the cable, of bifilar toroidal coils arranged in an orderly cluster around the axis of the stub cable. A first pair or insulated wires extends from the stub cable to each coil and the ends of this first pair are connected to first ends of the two windings of the coil. The second ends of the coil windings are connected to a second pair of insulated wires which extend back to the stub cable. Load coil assemblies are employed to provide an inductance in each pair of conductors in a communications cable and the ends of the conductors in the stub cable are therefore spliced to the conductors of the cable so that the individual coils are connected in series with the conductors in the main cable.

The manufacture of loading coil assemblies thus requires a large number of coils and electrical connections between the coils and the conductors of the stub cable. A variety of arrangements are used, or have been proposed, for supporting the individual coils adjacent to the stub cable and forming the electrical connections required; see for example U.S. Pat. Nos. 3,845,435; 3,952,906; 3,865,980 and 3,988,707. In general, a substantial amount of supporting structure is required for the individual coils and a large number of terminal sites must be provided for the electrical connections between the stub coil conductors and the coil windings.

The present invention is directed to the achievement of an improved toroidal coil supporting means having an integral terminal-receiving housing which is intended for use in the manufacture of load coil assemblies. The terminal housing receives terminals by means of which the windings of the coil are connected to the insulated conductors from the stub coil and the integral coil supporting and locating means which is integral with the housing has interengageable latches by means of which an individual coil can be latched to adjacent coils in a stack of identical coils. The integral latching means eliminates the need for many of the coil supporting or locating devices used in previous load coil assemblies.

PRACTICE OF THE INVENTION

Figure 1:
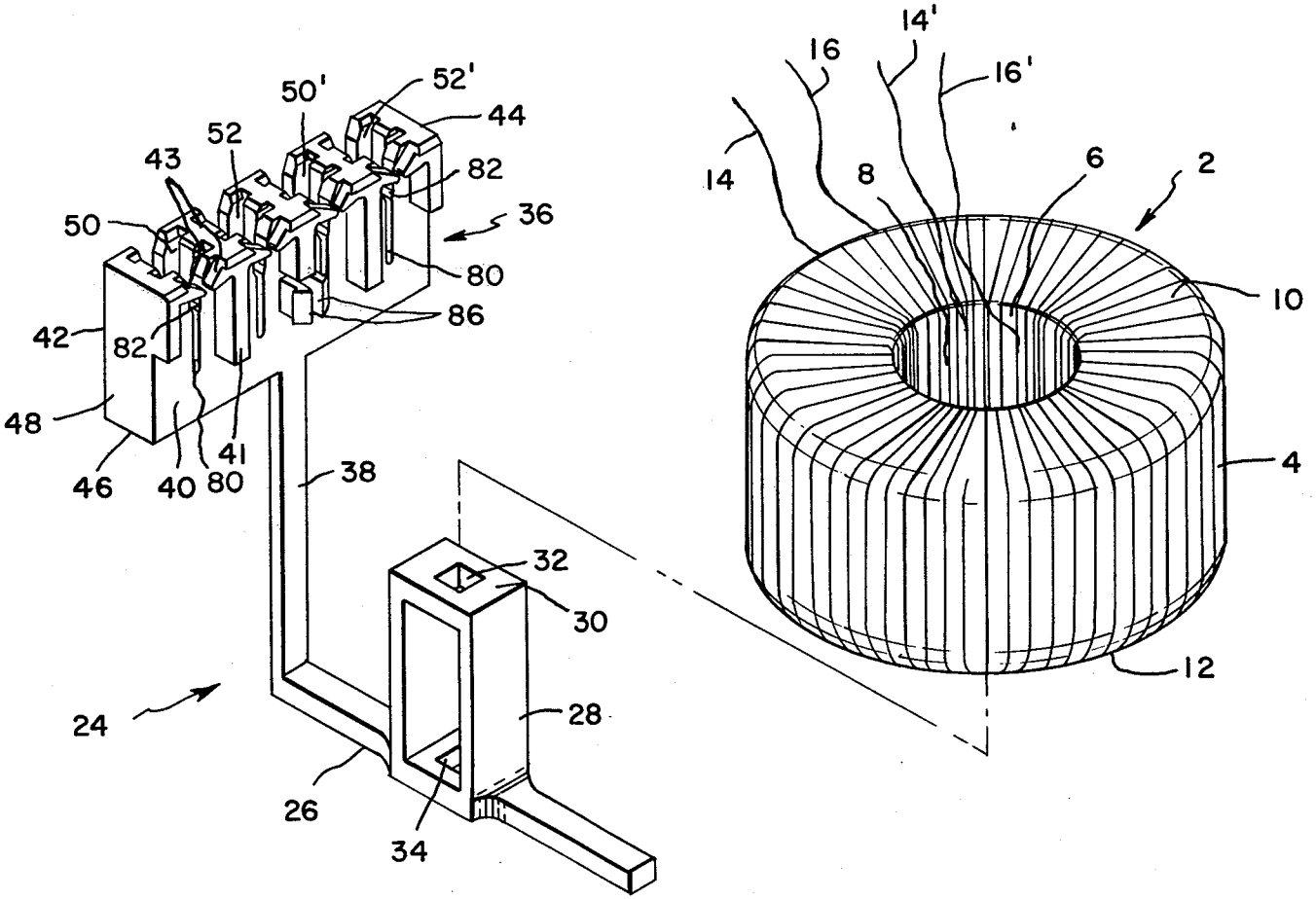
FIG. 1 is a perspective view showing a terminal housing and coil supporting means in accordance with the invention and showing a typical bifilar toroidal coil exploded from the support post of the housing and supporting means.
Figures 2, 3:
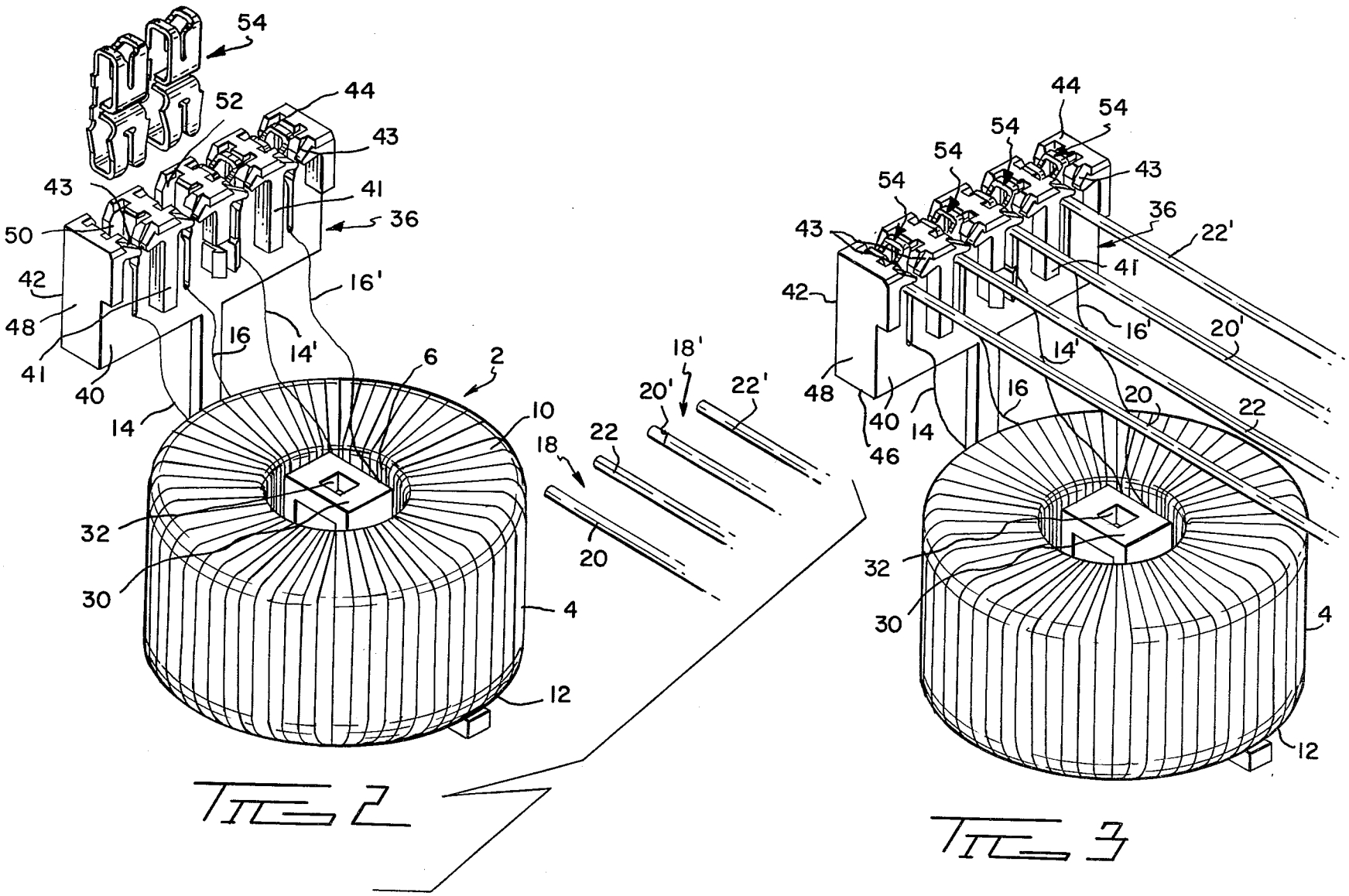
FIGS. 2–4 are views similar to FIG. 1 but showing the coil positioned on the support portion and the conductors from the coil extending to the housing (FIG. 2), the electrical connections between the insulated conductors and the coil windings (FIG. 3) and two coils stacked against each other (FIG. 4).

Referring first to FIGS. 1–4, a typical bifilar coil of the type used in loading coil assembly is in the form of a toroid having a circumferential outer surface 4, a central opening 8, an inner cylindrical surface 6, and oppositely facing side surfaces 10, 12. The conductors of the two windings are of relatively fine (AWG 30 or finer) wires having a varnish type insulating coating and having ends 14, 14' for the one winding and 16, 16' for the other winding.

As will be explained below, in a loading coil assembly, the windings are connected to pairs 18, 18' of insulated wires, the wire pair 18 comprising individual wires 20, 22 which are connected to the ends 14, 16 and the pair 18' comprising wires 20', 22' which are connected to the ends 14', 16'.

A terminal housing and coil supporting device in accordance with the invention is in the form of a one-piece molding of thermoplastic material, such as a glass filled nylon, and comprises a coil support portion 26, a terminal housing 36, and a housing support arm 38. The coil support portion 26 comprises an arm having a length equal to the diameter of the coil and a centrally located coil locating post 28 which extends from the arm and which is dimensioned to be received in the central opening 8 of the coil. An opening 32 is provided in the upper free end 30 of arm 28 and is dimensioned to receive latching fingers 86 which extend from the housing 36. A similar opening 34 is provided in the base of the post 28 and is dimensioned to receive latching fingers 88 which extend from an identical housing on an adjacent coil in a stack of coils.

The housing 36 is elevated above the free end 30 of the post 28 by a distance such that it can be moved against the surface 10 of the coil with accompanying flexure of the arm 38. The housing has generally rectangular surfaces including oppositely facing relatively wide side surfaces 40, 42, an upwardly facing (as viewed in FIG. 1) terminal-receiving face 44, downwardly facing base surface 46 and oppositely facing end surfaces 48.

Figure 5:
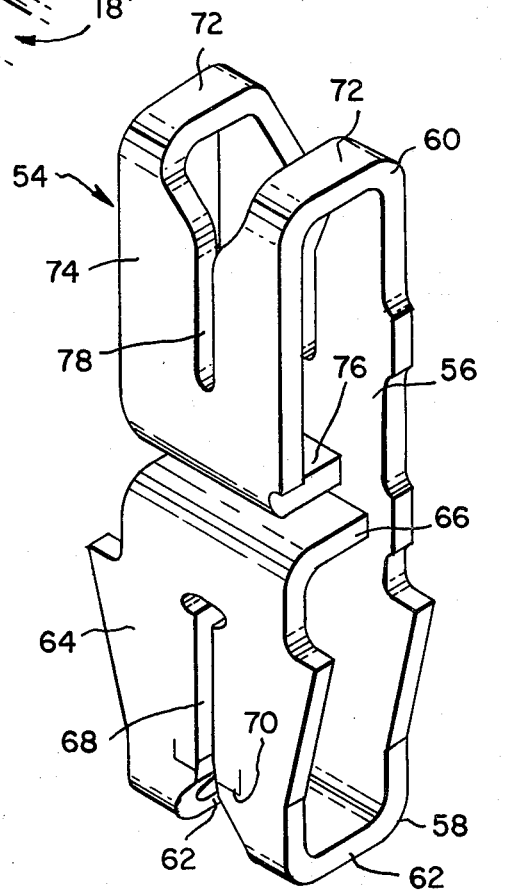
FIG. 5 is a perspective view of a terminal used in the practice of the invention.

Four terminal-receiving cavities 50, 52 and 50', 52' extend into the terminal-receiving face 44 and are dimensioned to receive double-ended terminals as shown at 54, FIG. 5. Each terminal is of stamped and formed conductive metal and has a central web portion 56 extending between the ends 58 and 60. End 60 receives, and establishes electrical contact with, one of the coil wires and this end comprises a plate-like section 64 which extends parallel to the web 56 and which is connected to the web by spaced-apart integral straps 62. A stabilizing flange 66 extends from the plate-like section 64 towards the web and aligned slots 68 are provided in the web 56 and the plate-like section 64 for reception of a coil wire. These slots have a width which is slightly less than the diameter of one of the coil wires so that when a wire moves relatively into the aligned slots, the insulation of the wire will be penetrated and electrical contact established. Narrow shoulders are provided at the entrance end of each slot as shown at 70, by shearing the metal adjacent to the slot along L-shaped shear lines and then forcing the sheared sections back into the plane of the plate-like section 64. The rough edges produced by the shearing operation produce very narrow shoulders or ledges at the entrance to the slot which dig into the insulation of the wire.

The end 60 of the terminal comprises a similar plate-like section 74, spaced-apart connecting straps 72 and an inwardly turned stabilized flange 76. The wire-receiving slots 78 are dimensioned to receive and establish electrical contact with one of the insulated wires.

Figure 6:
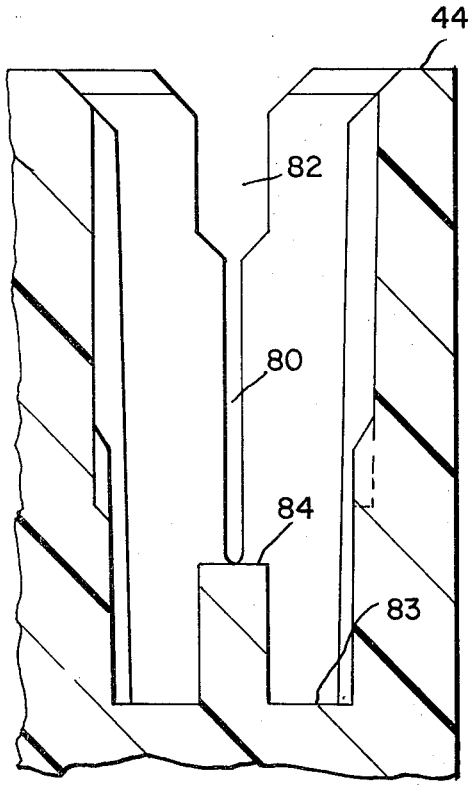
FIG. 6 is a sectional view of one of the cavities in the terminal housing.

As shown in FIG. 6, each of the cavities, 50, 52 and 50', 52' is dimensioned to receive a terminal in an orientation such that the webs 56 of the terminals will be parallel to the surfaces 40 and 42. Wire-admitting slots 82, 84 extend from the face 44 partially along the sides 40 and 42 of the housing and communicate with the individual cavities. The lower portions 80 of these wire-admitting slots are relatively narrow and are intended to receive only one of the coil winding wires 14, 14', 16, 16' while the upper portions 82 are dimensioned to receive one of the insulated wires 20, 22, 20', 22'. A centrally located column extends upwardly from the floor 83 of each cavity and this column has an upper surface 84 which supports one of the coil wires during movement of a terminal into the cavity.

Projecting ribs 41 are provided on the side surfaces 40 between the wire-admitting slots in this surface and wire-retaining ears 43 extend laterally from the ends of these ribs which are adjacent to the terminal-receiving face 44 of the housing. The ends of adjacent ears 43 are proximate to each other and the ears are somewhat flexible and inclined downwardly as viewed in FIG. 2, as shown. The ears 43 function as wire-retaining means for the lead wires 20, 22 and 20', 22', in that the ears will flex downwardly to permit movement of the lead wires into the wire-admitting slots but they will resist upward flexure, as viewed in FIG. 2, if a tensile force is applied to the lead wire. This strain relief function of the ears 43 can be appreciated from FIG. 4, if it is assumed that tensile forces are applied to the lead wires shown in FIG. 4.

The coil wires and the insulated wires are electrically connected to the terminals in a manner which is described more fully in U.S. Pat. Nos. 4,118,103 and 3,979,615. Modifications to these known methods would be provided to support the housing 36 during insertion of the terminals and wires and cut-off tooling would be provided to trim the wires during insertion.

Figure 4:
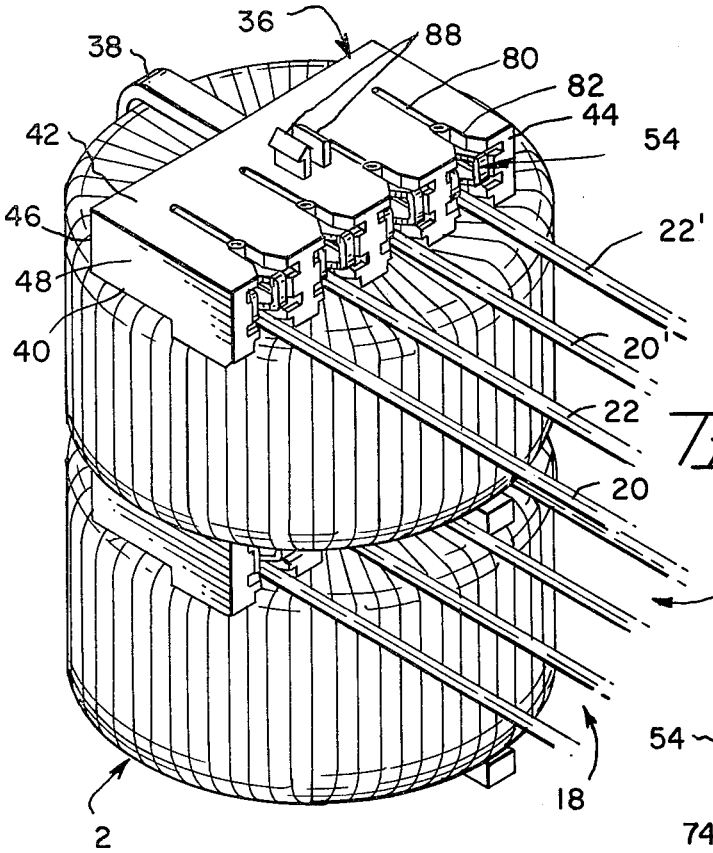

The previously identified latching fingers 86 extend from the surface 40 of the housing and are located such that they will enter the opening 32 when the housing is moved against the side 10 of the coil with accompanying bending of the housing support arm 38. The fingers and opening thus constitute a first latching means, the fingers having shoulders on their ends which bear against the surfaces adjacent to the opening 32. The latching fingers 88, FIG. 4, are similar to the latching fingers 86 and are dimensioned to enter the opening 34 in the support portion 46 of a supporting means on an adjacent coil. It will thus be seen from FIG. 4 that any desired number of coils can be stacked against each other on a common axes and the stack will be stabilized by virtue of the fact that the housings and coil locating posts on adjacent coils are latched to each other.

In the foregoing description, it is assumed that it is preferable to have the wires of the two pairs 18, 18' extending away from the side 40 of the housing so that these wires will extend from beneath the housing when the housing is against the coil as shown in FIG. 4. As an alternative, the insulated wires of the wire pairs can extend from the side 42 of the housing.

Figure 7:
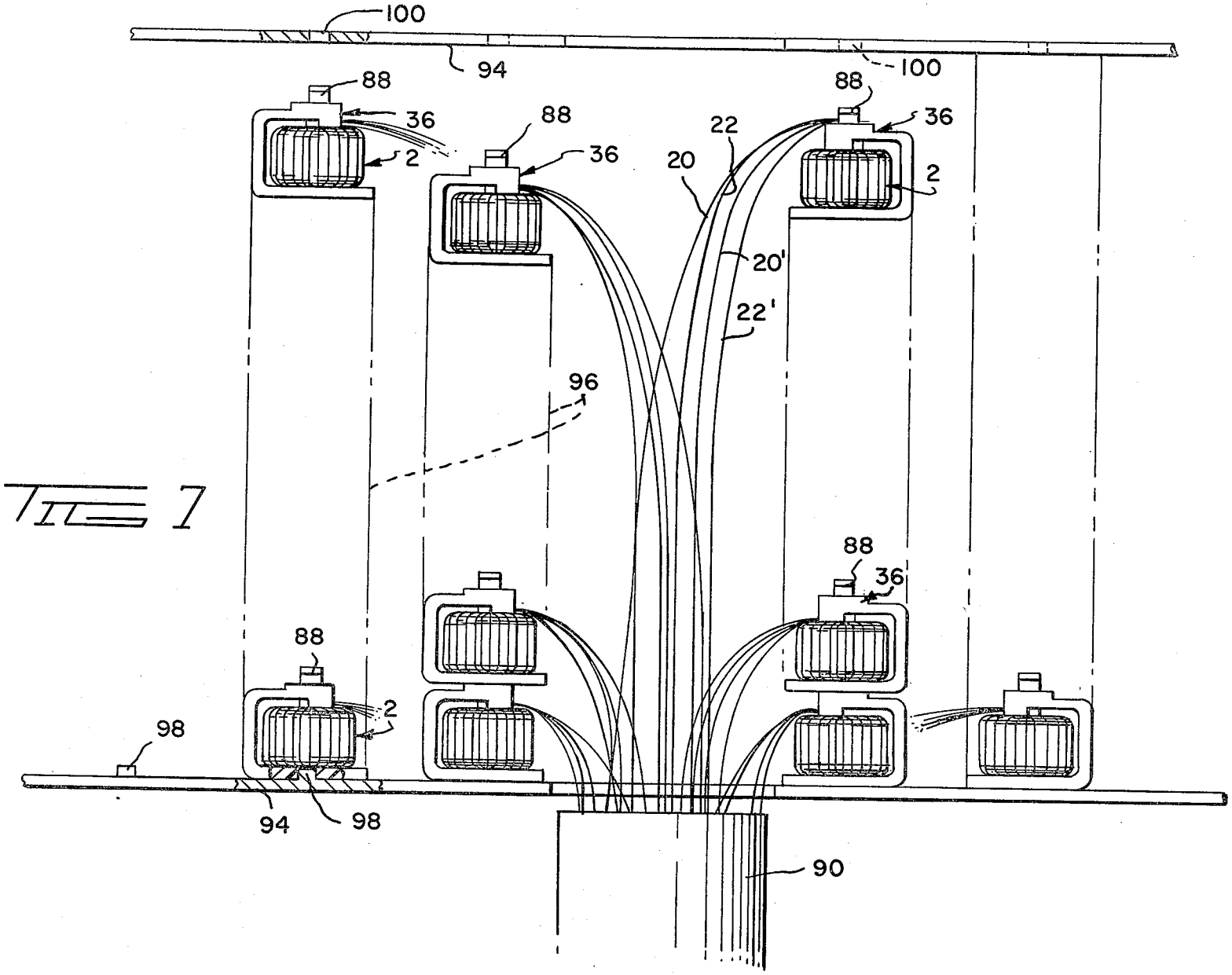
FIG. 7 is a semi-diagrammatic view of a load coil assembly in accordance with the invention.

As shown in FIG. 7, a loading coil assembly comprises a stub cable 90 containing a number of wire pairs which is equal to twice the number of wire pairs in the service cable in which the coil assembly is to be used. The stub cable 90 extends centrally through two or more tray-like retainers 92, 94 and the individual coils are stacked in a plurality of stacks 96 which are between these retainers or trays with the axes of the stacks extending parallel to the axis of the stub cable 90. Projections 98 can be provided on the lower tray 92 which are dimensioned to enter the openings 34 in the coil support members of the lowest layer of coils and openings, or recesses, are also provided as shown at 100 in the upper tray 94 to receive the latching fingers 88 of the uppermost layer of coils. The stacks will thus be supported at each end and since the coils in the stacks are secured to each other, only limited if any, additional supported means need to used. The loading coil assembly of FIG. 7 may be provided with such additional supporting means, such as support rods extending between the trays, as may be required by the number of coils in the cluster. Additionally, shielding washers may be provided between adjacent coils in each stack to prevent cross-talk between coils. The clearance between coils is sufficient to permit such washers where required. It may also be desirable under some circumstances to provide additional insulation in the loading coil assembly, such as plastic tubes in surrounding relationship to each stack 96. Quite often, the entire loading coil assembly is potted with a resin such as epoxy.

Alternative means might be provided to support the individual coils rather than the supporting column 28. For example, a pair of relatively simple spaced-apart fingers can be provided on the arm 26 which are capable of flexing towards each other to permit passage of the fingers through the central opening 8 of the coil. Such fingers can be provided with enlarged upper ends having laterally extending portions which would project over the upper surface 10 of the coil.

I claim:

1. A device for supporting a toroidal coil in a stack containing a plurality of identical coils, said device having integral terminal housing means for connecting the wires in said coil to lead wires, said device comprising:

a one-piece molded plastic member having a coil support portion extending in a first plane, a coil locating post means extending normally from said coil support portion at a central location thereon, said locating post means being dimensioned to be received in the open center of said toroidal coil and accurately locate said coil with said coil on said coil support portion, said post means having a free end which is spaced from said support portion by a distance substantially equal to the height of said coil, a deformable housing support arm extending normally from said coil support portion, said housing support arm being spaced from said locating post means by a distance which is sufficient to receive a section of said toroidal coil between said arm and said post means, said housing support arm having a terminal-receiving housing on its end, a plurality of terminal-receiving cavities extending into said housing, each of said cavities being dimensioned to receive a terminal for connecting a coil wire to a lead wire, first interengaging means on said housing and on said free end of said locating post means for securing said housing to said free end with said housing substantially against said one side of said coil, and second interengaging means on said housing and on said coil support portion for securing said device to identical devices on identical coils which are stacked against said coil on a common axis whereby, upon positioning said coil on said coil support portion with said locating post means extending through the central opening in said coil, connecting the wires of said coil to lead wires by means of terminals received in said cavities, and bending said housing support arm to position said housing against said free end of said locating post means, said housing can be secured to said free end of said locating post means by said first interengaging means, and said device and said coil can be stacked against identical coils and secured to said identical coils by said second interengaging means.

2. A device as set forth in claim 1, said coil support portion comprising an arm extending from said housing support arm.

3. A device as set forth in claim 1, said first interengaging means comprising a first opening in said free end of said locating post means and first latching finger means extending from said housing, said first latching finger means being dimensioned to enter said first opening and latch said housing to said free end of said locating post means.

4. A device as set forth in claim 2, said second interengaging means comprising second latching finger means and a second opening, said second latching finger means being on said housing and extending away from said housing and parallel to the axis of said locating post means when said housing is secured to said locating post means, said second opening being in said coil support portion of an identical device on an identical coil and in axial alignment with said axis of said locating post means.

5. A device as set forth in claim 1, said housing having parallel external side surfaces and a terminal-receiving face extending between said side surfaces, said side surfaces extending in planes parallel to the axis of said locating post means and said terminal-receiving face extending in a plane extending parallel to said support portion, said terminal-receiving cavities extending into said terminal-receiving face, wire-admitting slot means extending from said terminal-receiving face partially along said side surfaces, said wire-admitting slot means communicating with said cavities and being dimensioned to receive said coil wires and said lead wires.

6. A device as set forth in claim 5, said first interengaging means comprising latching finger means and an opening, said latching finger means extending from said one of said external side surfaces which is proximate to said coil locating post means, said opening being in said free end of said locating post means and being dimensioned to receive said latching finger means.

7. A loading coil assembly of the type comprising a cable having a plurality of wire pairs therein and a plurality, equal to one half of the number of said wire pairs, of bifilar toroidal induction coils, said coils being arranged in an orderly cluster around the axis of said cable, a first wire pair extending from said cable to each of said coils, the ends of the wires of said first pair being connected to first ends of the windings of the coil, a second wire pair extending from said cable to each of said coils, the ends of wires of the second pair being connected to the second ends of the windings of the coil, said coils being arranged in a plurality of coil stacks, each of said coil stacks comprising a plurality of coils disposed substantially against each other on a common axis which extends parallel to the axis of said cable and which axis extends through the central openings of said coils, each of said coils having associated therewith a terminal housing and coil supporting and securing means, said terminal housing for each coil comprising a rectangular block of insulating material disposed against one side of said coil and extending diametricaly across said one side, said housing having terminal-receiving cavities therein and having a terminal in each of said cavities, said ends of all of said wires extending to, and being selectively connected to each other by said terminals, said coil supporting and securing means associated with each of said coils comprising a coil locating post means extending through the central opening of said coil and having one end which is against said housing and having another end at the side of said coil which is opposite to said one side, first interengaging means on said housing and said one end and serving to secure said housing to said one end of said post means, and second interengaging means on said other end of said locating post means and on said housing, said second interengaging means serving to secure said housing and supporting means associated with each coil to the housing and supporting means associated with the juxtaposed coils in the same stack, and spaced-apart stack supporting means surrounding said axis of said cable, said coil stacks being between, and being supported by, said stack supporting means.

8. A loading coil assembly as set forth in claim 7, each of said terminal housing and coil supporting and securing means having a coil supporting arm extending diametrically across the side of said coil which is opposite to said one side, said locating post means being integral with, and extending from, said coil supporting arm.

9. A loading coil assembly as set forth in claim 8, each of said terminal housing and coil supporting and securing means having a housing supporting arm extending from said coil supporting arm at one end thereof, across the outer circumferential surface of the associated coil to said housing, said housing supporting arm being integral with its associated housing.

10. A loading coil assembly as set forth in claim 9, said first interengaging means comprising latching fingers on said housing, said locating post means having shoulder surfaces for engagement with said latching fingers.

11. A loading coil assembly as set forth in claim 10, said second interengaging means comprising latching fingers extending from the housing of a juxtaposed coil and shoulder surfaces on the other end of said locating post means.

12. A loading coil assembly as set forth in claim 7, said stack supporting means comprising parallel spaced-apart stack supporting trays, said cable extending normally of said trays.

* * * * *